US006222428B1

(12) United States Patent
Akesson et al.

(10) Patent No.: US 6,222,428 B1
(45) Date of Patent: Apr. 24, 2001

(54) TUNING ASSEMBLY FOR A DIELECTRICAL RESONATOR IN A CAVITY

(75) Inventors: Daniel Akesson, Hässelby; Jan Malmström, Saltsjö Boo, both of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/332,976

(22) Filed: Jun. 15, 1999

(51) Int. Cl.[7] ..... H01P 7/06
(52) U.S. Cl. ..... 333/202; 333/219.1; 333/235
(58) Field of Search ..... 333/235, 232, 333/219.1, 202

(56) References Cited

U.S. PATENT DOCUMENTS

| | | | | |
|---|---|---|---|---|
| 4,613,838 | * | 9/1986 | Wada et al. | 333/232 |
| 4,728,913 | * | 3/1988 | Ishikawa et al. | 333/235 |
| 5,111,170 | * | 5/1992 | Ohya | 333/219.1 |
| 5,691,677 | * | 11/1997 | De Maron et al. | 333/219.1 |
| 5,748,060 | * | 5/1998 | Sarkka | 333/235 |
| 6,005,453 | * | 12/1999 | Sarkka et al. | 333/126 |

FOREIGN PATENT DOCUMENTS

| | | | | |
|---|---|---|---|---|
| 492304A1 | * | 12/1991 | (EP) | 333/235 |
| WO97/02617 | | 1/1997 | (WO) . | |
| WO98/56062 | | 12/1998 | (WO) . | |

* cited by examiner

*Primary Examiner*—Benny Lee
*Assistant Examiner*—Stephen E. Jones
(74) *Attorney, Agent, or Firm*—Jacobson, Price, Holman & Stern, PLLC

(57) ABSTRACT

A tuning assembly for tuning the resonant frequency of a dielectric resonator in a cavity. The assembly includes a first resonator body (21) secured to a tubular sleeve portion (33) mounted in an opening **(14*a*) of a mounting wall (14). The sleeve portion (33) is spring loaded so as to exert a clamping force on the first resonator body (21). A second resonator body (22) is secured to a shaft (35) which is journalled inside the tubular sleeve portion (31). The tubular sleeve portion (33) and the shaft (35) are axially slidable in relation to each other, whereby the position of one of the resonator bodies (22) is precisely adjustable in relation to the other resonator body (21)**.

29 Claims, 3 Drawing Sheets

TUNING ASSEMBLY FOR A DIELECTRICAL RESONATOR IN A CAVITY

BACKGROUND OF THE INVENTION

1. Field of the Invention

The present invention relates to tuning assembly for tuning a dielectric resonator in a cavity defined by cavity walls. The invention also concerns a filter employing such a tuning assembly.

The dielectric resonator includes two resonator bodies, namely a stationary resonator body and a movable resonator body, each of the two resonator bodies being made of a low-loss, high dielectric constant material.

The tuning assembly comprises a support structure mounted in an opening in a mounting wall, constituting one of the cavity walls, for supporting the two resonator bodies within the cavity. The support structure includes two mutually slidable support elements, viz. a first support element, including a tubular sleeve portion, for supporting a first one of the two resonator bodies, and a second support element, including a shaft extending axially through the mounting wall opening and inside the tubular sleeve portion, for supporting a second one of the two resonator bodies. One of the support elements is displaceable from the outside by a tuning adjustment means to effect an adjustment movement of one resonator body in relation to the other resonator body, whereby a resonant frequency of the dielectric resonator in the cavity can be tuned.

2. Prior Art

Such a tuning assembly is previously known from the published international patent application WO 97/02617 (Allen Telecom). The known tuning assembly is disposed in a filter including a number of neighbouring cavities, each having a dielectric resonator and a plastic resonator support. The resonator support is mounted in one mounting wall only. Thus, unlike many similar support structures, it is not guided or supported in the opposite wall of the casing. A tuning assembly of the latter kind is disclosed in WO98/56062 (Allgon AB), the contents of which are incorporated herein by reference.

In one embodiment, shown in FIGS. 8 through 10 of the first-mentioned document WO 97/02617, the dielectric resonator includes two cylindrical resonator bodies in the form annular ring members, one stationary and one movable, both of them being made of a low-loss, high dielectric constant ceramic material. The first, stationary resonator body is mounted on a plastic support in the form of a cylindrical sleeve having a plurality of longitudinal recesses and openings so as to make the support somewhat flexible. At the inner end, to be located inside the cavity, the sleeve is cut out so as to form a number of spaced apart holding elements or arms diverging from a shoulder. When mounting the first, stationary resonator body onto the plastic support, it is pushed with its central axial hole onto the diverging arms.

When the first, stationary resonator body reaches a position where it abuts the shoulder of the plastic support, the arms will snap radially outwardly and engage with cantilevered stops onto the upper or inner surface of the cylindrical resonator body so as to hold the latter with a clamping force between the cantilevered stops and the shoulder. In this way, the first resonator body will be held substantially stationary by the plastic support.

The second resonator body, on the other hand, is secured to an adjustment shaft, which is mounted so as to extend through the mounting wall opening and axially inside the supporting cylindrical sleeve. The adjustment shaft is threaded at an axially outer portion thereof and is rotatable so as to perform a linear movement in relation to the plastic support and the first, stationary resonator body. The rotational movement can be accomplished manually, by means of a knurled outer head on the shaft, or automatically by a stepping motor. Thus, tuning can be achieved by such a movement of the adjustment shaft and an associated displacement of the second resonator body in relation to the first resonator body.

However, the plastic material of the support structure, which is necessarily flexible to enable the desired snap locking of the first resonator body, will inevitably make the mounting of the first resonator body somewhat resilient and not quite exact in a fixed position. Moreover, the adjustment shaft, which extends freely inside the support sleeve, is allowed to orient itself at a slight inclinational angle in relation to the support sleeve, whereby the second resonator body will be tilted in relation to the first resonator body.

Accordingly, the mounting of the first resonator body onto the support structure is not quite exact, and the tuning can only be achieved approximately, i.e. for a given rotational movement of the adjustment shaft, the mutual positions of the first and second resonator bodies can vary somewhat with an associated shift of the resonant frequency.

SUMMARY OF THE INVENTION

Against this background, a main object of the invention is to provide a tuning assembly, which is more precise in its tuning process, so that a given adjustment movement will result in a predetermined, exact resonant frequency.

A further object is to provide a tuning assembly which is easy to manufacture and assemble.

Still another object is to provide a structure of the tuning assembly which will secure an efficient transfer of heat from the dielectric resonator to the outside of the cavity.

The stated main object is achieved for a tuning assembly, comprising:

- a mounting wall constituting at least a part of one of the cavity walls and having an inside defining the cavity and an outside provided with a tuning adjustment means. There is
- a support structure mounted in an opening in the mounting wall for supporting the two resonator bodies on the inside of the mounting wall.

The support structure including two mutually slidable support elements, each being made of a rigid material, with

- a first support element including a tubular sleeve portion and a radially outer support means for clamping a first one of said two resonator bodies axially between the tubular sleeve portion and the radially outer support means, and
- a second support element including a shaft being radially journalled by bearing means inside the tubular sleeve portion, at least in a region located axially inside the mounting wall, and carrying at an end portion thereof a second one of the two resonator bodies.

One of said two mutually slidable support elements being held stationary in relation to the mounting wall, whereas the other one of said two mutually slidable suppor elements is axially movable of the tuning adjustment means on the outside of said mounting wall.

The two slidable support elements are exactly aligned in relation to each other, and the two resonator bodies are precisely positionable in relation to each other so as to tune a resonant frequency of the dielectric resonator.

Accordingly, the frequency tuning can be made very precise, and the relative positions of the two resonator bodies will be retained exactly, even if the assembly is disturbed by vibrations or other movements. Nevertheless, the manufacture of the tuning assembly, and the mounting of the various parts are relatively inexpensive and easy to carry out in practice.

It is important that the shaft is journalled precisely by bearing means inside the tubular sleeve portion, at least in the region axially inside the mounting wall, so that the shaft and the tubular sleeve portion, and thus the two mutually slidable support elements, are aligned exactly relative to each other.

In order to achieve improved stability, the radially outer support means of the first support element is preferably located radially outside the tubular sleeve portion, e.g. in the form of an outer sleeve. Advantageously, the latter is heat conductive so as to lead away the heat generated in the first resonator body to the mounting wall.

A practical way to achieve an axial clamping force between the tubular sleeve portion and the radially outer support means is to mount the tubular sleeve portion slidably in the mounting wall opening and to apply a resilient load outside the opening, e.g., by means of a spring member, so that the tubular sleeve portion exerts an axial force on the first resonator body against the radially outer support means. As an alternative, the radially outer support means, e.g. in the form of an outer sleeve, may be spring loaded so as to exert an axial force on the first resonator body, which is then held securely in a stationary position by means of the tubular sleeve portion. In such a case, the latter serves as an abutment member.

Of course, in case the support structure includes a central tubular sleeve portion as well as an outer support sleeve, at a radial distance from the central tubular sleeve portion, the first resonator body will be supported firmly and securely without permitting any tilting or inclinational movements. So, the first resonator body will assume an exact, well-defined stationary position at a distance from the inside of the mounting wall of the cavity. Since the second resonator body is securely held in position by the central bearing of the shaft, serving as an adjustment shaft, inside and along the tubular sleeve portion, the first and second resonator bodies are precisely positioned in relation to each other.

In another possible embodiment, the second support element, which carries the second resonator body, is held stationary, whereas the first support element, which carries the first resonator body, is axially movable in relation to the mounting wall and the second support element.

Further advantageous features are indicated in the claims and will also appear from the detailed description below.

The invention will be explained further below with reference to the appended drawing illustrating some preferred embodiments.

DETAILED DESCRIPTION OF PREFERRED EMBODIMENTS

Figure 1:
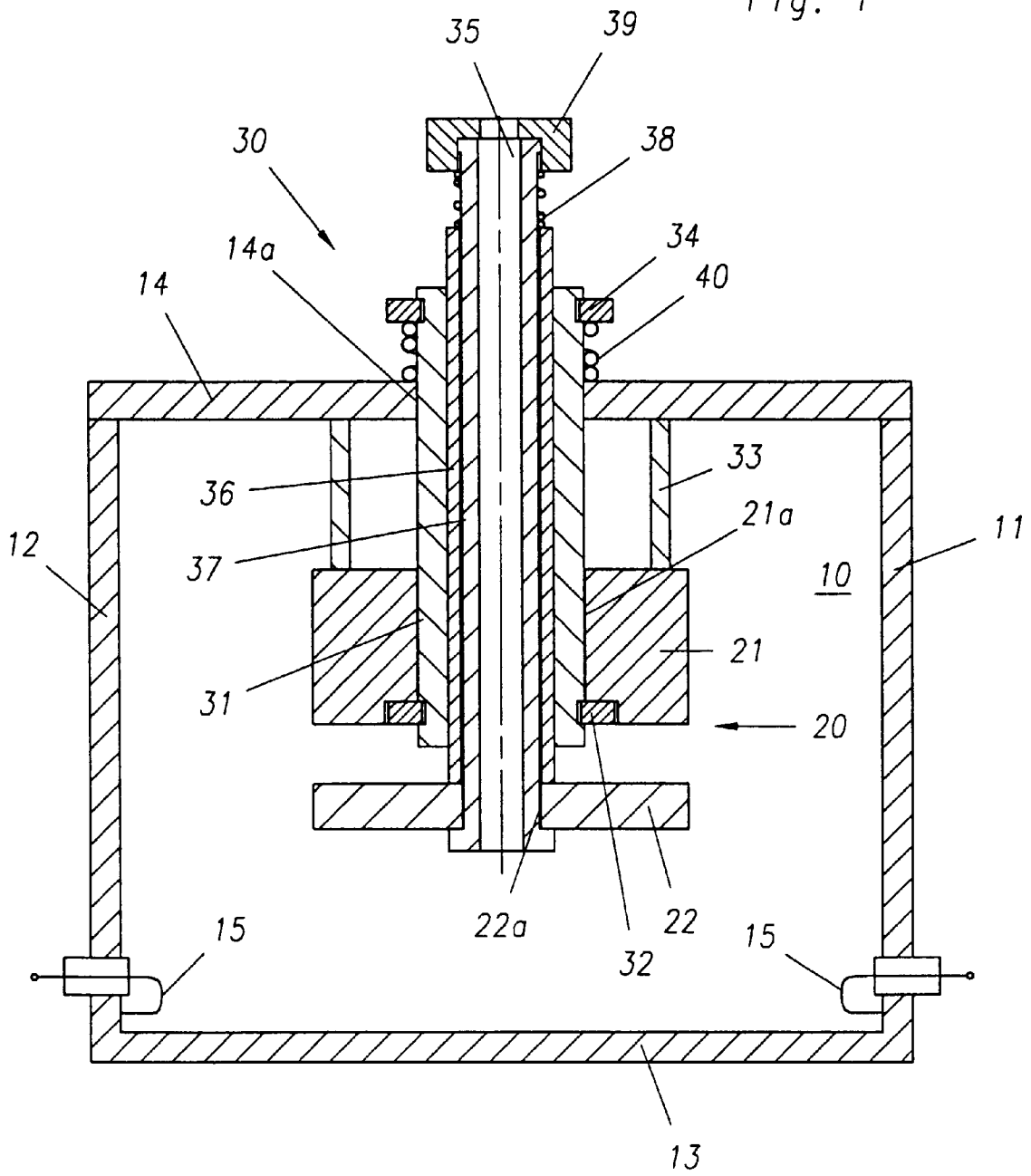
FIG. 1 shows, in a central cross-sectional view, a cavity provided with a dielectric resonator and a tuning assembly according to a first embodiment of the invention.

The device shown in FIG. 1 is disposed in a cavity 10, which may be cylindrical or box-like and is defined by casing or cavity walls, including side walls 11,12, a bottom wall 13 and a top wall or lid 14, the latter serving as a mounting wall for mounting a tuning assembly with a support structure 30 for supporting a dielectric resonator 20 in the cavity. In order to couple the resonator 20 to a feeding network or the like, inductive coupling loops 15 are arranged in the cavity 10. Depending of the particular application, other means of exciting an electromagnetic field within the cavity and the resonator are also possible.

The dielectric resonator 20 includes a first, stationary resonator body 21 and a second, movable resonator body 22. The two resonator bodies are made of a material exhibiting low dielectric losses and having a high relative dielectric constant, typically a ceramic material, as is well-known to those skilled in the art.

In the illustrated example, the first resonator body 21 is cylindrical in shape, with a central axial hole 21*a* which is also cylindrical. In the region of this central hole 21*a*, the first resonator body 21 is firmly secured to a tubular sleeve portion 31 having an outer cylindrical surface fitting into the axial hole 21*a*. An axial locking therebetween is accomplished by means of a washer 32 fitted into oppositely located grooves in the resonator 21 and the tubular sleeve portion 31, respectively.

The tubular sleeve portion 31 forms a part of a first support element 30 having another part in the form of an outer sleeve member 33, the two parts 31,33 being axially movable in relation to each other for the purpose of clamping the first resonator body 21 axially therebetween. In the illustrated example, the tubular sleeve portion 31 is slidably mounted in a cylindrical opening 14*a* in the mounting wall and is axially loaded (upwards in the drawing) by means of a metal helical spring 40 acting between the outside surface of the mounting wall 14 and an abutment washer 34 inserted in a groove at the end portion of the tubular sleeve portion 31.

Accordingly, the tubular sleeve portion 31 is resiliently loaded so as to exert an axial clamping force on the first resonator body 21 against the outer sleeve member 33 located axially between the first resonator body 21 and the mounting wall 14 of the casing. The outer sleeve member 33 will act as an abutment and spacing element. In order to achieve good stability and a secure, well-defined fixation of the first resonator body 21, the outer sleeve member 33 has a much larger diameter than the central tubular sleeve portion 31, so that the circular abutment surface is located at a substantial radial distance from the circumference of the tubular sleeve portion 31.

In principle, the outer sleeve member 33 can be replaced by a number (preferably three or more) of separate spacing elements extending axially between the first resonator body 21, preferably adjacent to the peripheral portion of the latter, and the inside of the mounting wall 14. Moreover, the central tubular sleeve portion 31 may be fixed axially, in which case the outer sleeve member 33 or similar, possibly separate supporting means should be movable and mechanically loaded so as to exert an axial force onto the first resonator body 21 (downwards in the drawing).

The second resonator body 22 is shaped like a circular disc with a central hole 22*a* and is firmly secured to the end portion of an adjustment shaft 35, which is slidably fitted inside the tubular sleeve portion 31. The outer diameter of the shaft 35 is exactly dimensioned so as to form a bearing surface and ensure a sliding fit relative to the inside cylindrical surface of the tubular sleeve portion 31. In this way, the shaft 35 will be exactly aligned with the longitudinal axis of the tubular sleeve portion 31 irrespective of the particular axial position thereof. It is important that the two resonator bodies are preciesly positioned and do not have the possibility of being displaced during operation of the devices, which would change the precisely set resonant frequency. In order to avoid metal fitting parts, which would be heated to very high temperatures by the electromagnetic field, or a glue or other binding agent, which may deteriorate after long use, the second resonator body 22 is axially clamped between two concentric tube members 36,37 which together constitute the adjustment shaft 35 or second support element. The inner tube member 37 is slidable, with a sliding fit, inside the outer tube member 36, and the two members 36,37 are resiliently loaded axially by means of a metal helical spring 38 disposed at the outer end portion of the shaft 35, outside the mounting wall 14. Accordingly, the central portion of the second resonator body 22, adjacent to a central hole 22*a* thereof, is axially clamped between shoulder surfaces on the respective tube members 36,37.

In operation, the parts 22, 36 and 37 are held together as a unit and are axially slidable inside the stationary tubular sleeve portion 31. In order to effect a desired tuning of the device, this unit can be axially and/or rotationally displaced, either manually or automatically. For example, a threaded spindle on a stepping motor may engage with an internal screw thread at the inside of a nut 39 secured to the upper end of the adjustment shaft 35, so that the latter is displaced as desired, normally by a linear movement. Alternatively, the adjustment shaft may be rotated so as to cause the movable resonator body to be displaced axially by way of engaging the stationary resonator body with a helically climbing surface, as disclosed in the Swedish patent application No. 9802191-8, the contents of which are incorporated herein by reference.

Figure 2:
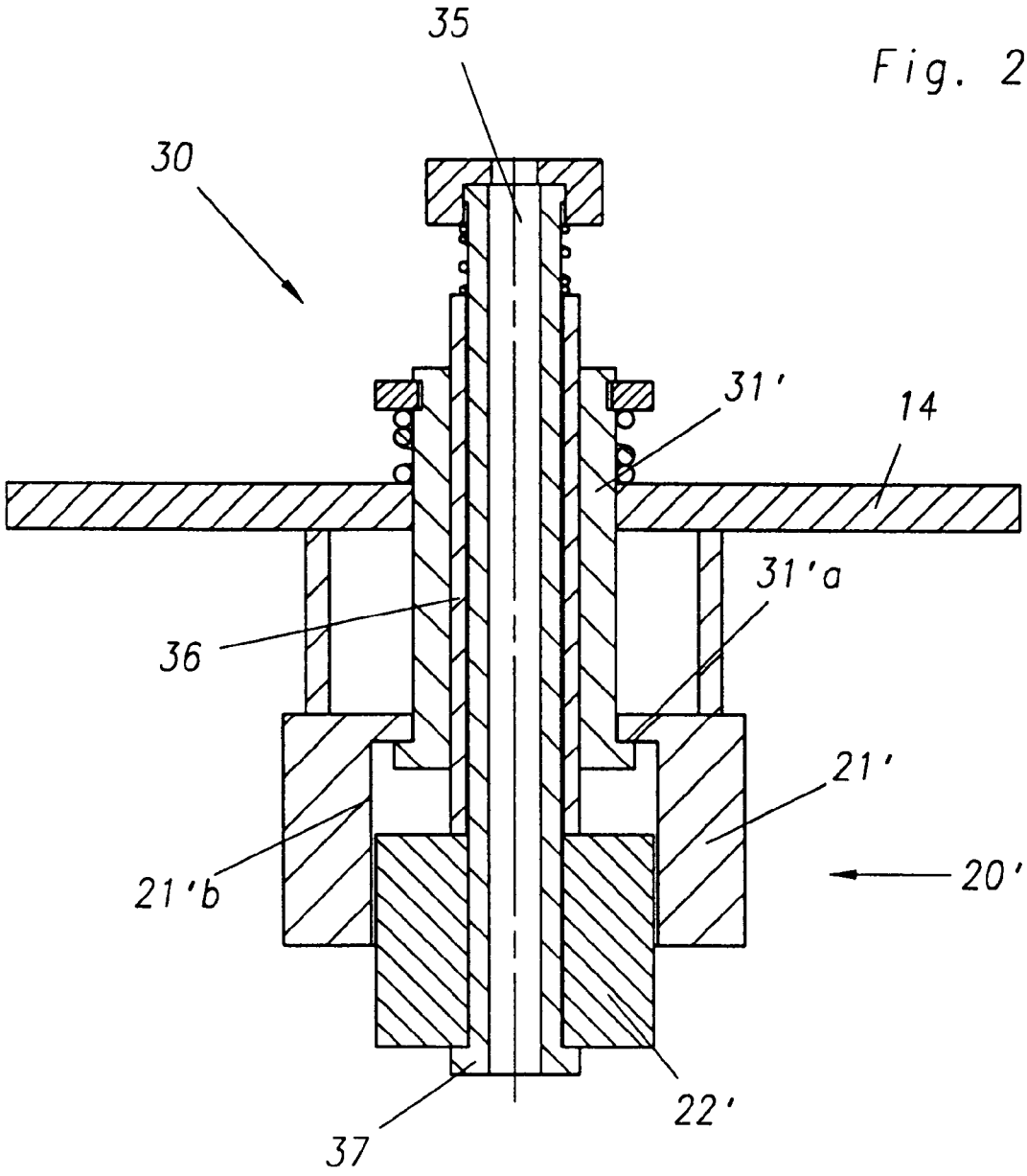
FIG. 2 shows, in a partial cross-sectional view, a tuning assembly according to a second embodiment of the invention.

In the second embodiment illustrated in FIG. 2, the geometrical shape of the dielectric resonator is different. The first, stationary resonator body 21' has a cylindrical recess 21'*b* at the portion facing away from the mounting wall 14, and the second, movable resonator body 22' has a smaller outer diameter so as to be freely displaceable in the cylindrical recess 21'*b*. The stationary resonator body 21' is secured to the sleeve portion 31' by means of a flange 31'*a*. Otherwise, the embodiment shown in FIG. 2 is identical to the one shown in FIG. 1.

Figure 3:
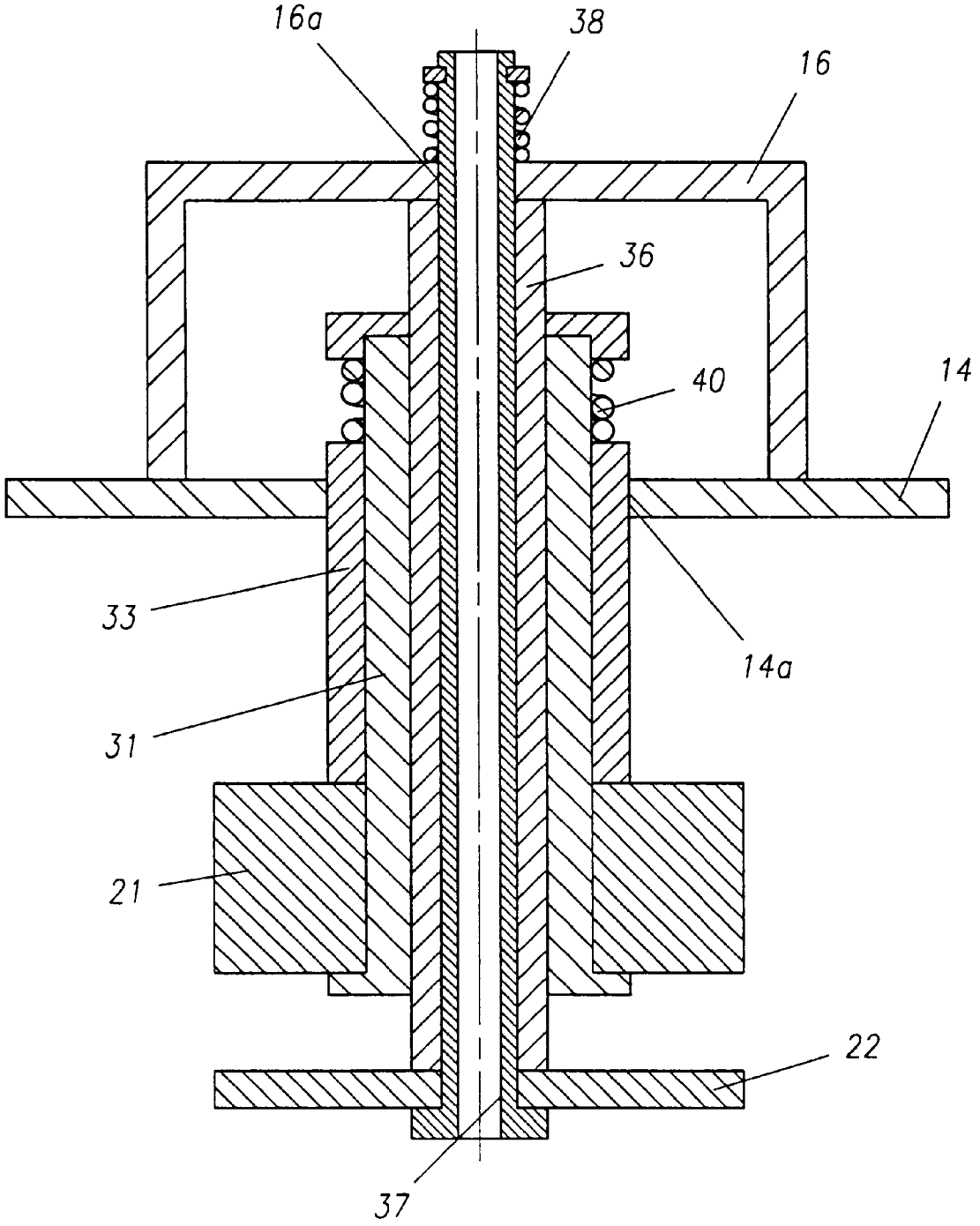
FIG. 3 shows, likewise in a partial cross-sectional view, a tuning assembly according to a third embodiment of the invention.

In the third embodiment, illustrated in FIG. 3, the first resonator body 21 is axially movable, whereas the second resonator body 22 is held in a stationary position by the tube members 36,37, which are fixed by a rigid cap member 16 secured on the outside of the mounting wall 14. The inner tube member 37 extends through an opening 16*a* in the cap member 16 and is spring-loaded upwards by a helical spring 38 so as to exert a clamping force, at its inner end in the cavity, on the second resonator body or disc 22.

The sleeve portion 31, which holds the first, circular-cylindrical resonator body 21, is in this case directly surrounded by the radially outer support sleeve 33. The latter is slidingly fitted in the opening 14*a* of the mounting wall 14, so that the sleeves 31,33, together with the resonator body 21, are axially movable as a unit. This unit can be displaced axially, e.g. by a rotary movement while engaging with threads on the outside of the sleeve 33 and the inside of the hole 14*a*.

In all three embodiments, the various sleeve members 31,33,36 should be made of a material exhibiting low dielectric loss and high thermal stability, such as quartz or alumina. Particularly, the outer sleeve member 33, which is used also for heat conduction, is preferably made of alumina exhibiting a higher thermal conductivity. The inner tube member 37 may be made of any suitable low loss material available, such as quartz, alumina or PTFE.

Of course, many modifications of the illustrated embodiments may be made by those skilled in art within the scope of the appended claims. For example, the tubular sleeve portion 31 may be integrated with the first resonator body 21, 21' so as to form one unitary piece. The same is true for the sleeve 36 and the second resonator body 22,22'.

The spring loading by means of the metal helical spring member 40 may alternatively be realized by means of a resilient O-ring made of silicon rubber or similar.

Moreover, the mounting wall 14, or a central portion thereof, may be axially displaceable in relation to the rest of the casing 11, 12, 13 in order to achieve fine tuning.

What is claimed is:

1. A tuning assembly for tuning a dielectric resonator in a cavity defined by cavity walls, said dielectric resonator including two resonator bodies, namely a stationary resonator body and a movable resonator body, each of said two resonator bodies being made of a low-loss, high dielectric constant material, said tuning assembly comprising:

a mounting wall constituting at least a part of one of said cavity walls and having an inside defining said cavity and an outside provided with a tuning adjustment means, a support structure mounted in only one of said cavity walls, namely in an opening in said mounting wall for supporting said two resonator bodies on said inside of the mounting wall, said support structure including two mutually slidable support elements, each being made of a rigid material, a first support element including a tubular sleeve portion and a radially outer support means for clamping a first one of said two resonator bodies axially between said tubular sleeve portion and said radially outer support means, and a second support element including a shaft being journalled inside said tubular sleeve portion, at least in a region located axially inside said mounting wall, and carrying at an end portion thereof a second one of said two resonator bodies, one of said two mutually slidable support elements being held stationary in relation to said mounting wall, whereas the other one of said two mutually slidable support elements is axially movable by said tuning adjustment means on said outside of said mounting wall, whereby said two slidable support elements are exactly aligned in relation to each other, and the two resonator bodies are precisely positionable in relation to each other so as to tune a resonant frequency of the dielectric resonator.

2. The tuning assembly defined in claim 1, wherein said radially outer support means is located at a radial distance from said tubular sleeve portion.

3. The tuning assembly defined in claim 2, wherein said second support element is axially movable, and said first support element is held stationary, said tubular sleeve portion being slidably mounted in said mounting wall opening and being resiliently loaded axially outside of said mounting wall so as to exert an axial clamping force on said first resonator body towards said mounting wall, and said outer support means serving as an abutment and spacing means for holding said first resonator body in a stationary position.

4. The tuning assembly defined in claim 2, wherein said radially outer support means is a cylindrical sleeve.

5. The tuning assembly defined in claim 1, wherein said radially outer support means is made of a dielectric material having a good heat conducting capacity and is dimensioned to transfer heat generated in said first resonator body to said mounting wall.

6. The tuning assembly defined in claim 1, wherein said first resonator body is circular-cylindrical with a central axial hole.

7. The tuning assembly defined in claim 6, wherein said tubular sleeve portion is a separate body being secured to said first resonator body in said central axial hole.

8. The tuning assembly defined in claim 1, wherein said shaft is fitted closely inside said tubular sleeve portion by means of mutually bearing cylindrical surfaces.

9. The tuning assembly defined in claim 8, wherein said mutually bearing cylindrical surfaces extend along substantially the whole axial length of said tubular sleeve portion.

10. The tuning assembly defined in claim 1, wherein said shaft comprises two concentric, cylindrical tube members being slidable one inside the other, and said second resonator body is axially clamped between said two concentric tube members.

11. The tuning assembly defined in claim 1, wherein said movable resonator body has the shape of a circular disc.

12. The tuning assembly defined in claim 11, wherein said stationary resonator body is circular-cylindrical with substantially the same outer diameter as said circular disc.

13. The tuning assembly defined in claim 1, wherein said second support element is held stationary, and said first support element is axially movable in relation to said mounting wall and said second support element.

14. The tuning assembly defined in claim 13, wherein said radially outer support means is an outer sleeve which surrounds said tubular sleeve portion and is movable through said mounting wall opening.

15. The tuning assembly defined in claim 14, wherein said outer sleeve is coupled to said tuning adjustment means at the outside of said mounting wall.

16. The tuning assembly defined in claim 14, wherein said outer sleeve and said tubular sleeve portion are axially clamped against said first dielectric resonator body by means of a spring member located outside said mounting wall.

17. A filter comprising a casing with walls defining a cavity, a dielectric resonator located in said cavity, including a stationary resonator body and a movable resonator body, means for generating a resonant electromagnetic field in said cavity and a tuning assembly, as defined in claim 1, for tuning a resonant frequency of said dielectric resonator.

18. A tuning assembly for tuning a dielectric resonator in a cavity defined by cavity walls, said dielectric resonator including two resonator bodies, namely a first, stationary resonator body and a second, movable resonator body, each of said two resonator bodies being made of a lowloss, high dielectric constant material, said tuning assembly comprising:

a mounting wall constituting at least a part of one of said cavity walls and having an inside defining said cavity and an outside provided with a tuning adjustment means, a support structure mounted in only one of said cavity walls, namely in an opening in said mounting wall for supporting said two resonator bodies on said inside of the mounting wall, said support structure including two mutually slidable support elements, each being made of a rigid material, namely a first support element including two parts being adapted to hold said first resonator body in a stationary position by an axial clamping force, one of said two parts including a tubular sleeve portion being secured to said first resonator body, and a second support element including an adjustment shaft being secured to said second, movable resonator body, said adjustment shaft extending axially through said mounting wall opening and being journalled inside said tubular sleeve portion, at least in a region located axially inside said mounting wall, so as to be axially movable by said tuning adjustment means on said outside of said mounting wall, whereby said two slidable support elements are exactly aligned in relation to each other, and the two resonator bodies are precisely positionable in relation to each other so as to tune a resonant frequency of the dielectric resonator.

19. The tuning assembly defined in claim 18, wherein a second one of said two parts of said first support element comprises a supporting means surrounding the circumference of said tubular sleeve portion at a radial distance therefrom.

20. The tuning assembly defined in claim 19, wherein said tubular sleeve portion is slidably mounted in said mounting wall opening and is resiliently loaded on said outside of said mounting wall so as to exert said axial clamping force on said first, stationary resonator body towards said mounting wall, and said supporting means serves as an abutment and spacing means for holding said first resonator body in said stationary position.

21. The tuning assembly defined in claim 19, wherein said supporting means is an outer cylindrical sleeve.

22. The tuning assembly defined in claim 19, wherein said supporting means is made of a dielectric material having a good heat conducting capacity and is dimensioned to efficiently transfer heat generated in said first resonator body to said mounting wall.

23. The tuning assembly defined in claim 18, wherein said first, stationary resonator body is circular-cylindrical with a central axial hole.

24. The tuning assembly defined in claim 23, wherein said tubular sleeve portion is a separate body being secured to said first resonator body in said central axial hole.

25. The tuning assembly defined in claim 18, wherein said adjustment shaft is fitted closely inside said tubular sleeve portion by means of mutually bearing cylindrical surfaces.

26. The tuning assembly defined in claim 25, wherein said mutually bearing cylindrical surfaces extend along substantially the whole axial length of said tubular sleeve portion.

27. The tuning assembly defined in claim 18, wherein said adjustment shaft comprises two concentric, cylindrical tube members being slidable one inside the other, and said second resonator body is axially clamped between said two concentric tube members.

28. The tuning assembly defined in claim 18, wherein said second, movable resonator body has the shape of a circular disc.

29. The tuning assembly defined in claim 28, wherein said first, stationary resonator body is circular-cylindrical with substantially the same outer diameter as said circular disc.

* * * * *